United States Patent [19]

Holman

[11] 4,197,779

[45] Apr. 15, 1980

[54] HIGH DENSITY BRIDGE PIN

[76] Inventor: Mitchell R. Holman, 15 Hoffman Ave., San Francisco, Calif. 94114

[21] Appl. No.: 18,840

[22] Filed: Mar. 8, 1979

[51] Int. Cl.[2] ..... G10D 3/04; G10D 3/12

[52] U.S. Cl. ..... 84/298; 84/297 R; 84/307

[58] Field of Search ..... 84/213, 214, 297–303, 84/307

[56] References Cited

U.S. PATENT DOCUMENTS

| | | | |
|---|---|---|---|
| 572,677 | 12/1896 | Goodwin | 84/298 |
| 2,265,885 | 12/1941 | Armstrong | 84/299 |
| 3,478,635 | 11/1969 | Conklin | 84/214 |
| 3,605,545 | 9/1971 | Rendell | 84/298 X |

FOREIGN PATENT DOCUMENTS

| | | | |
|---|---|---|---|
| 4042 | of 1878 | United Kingdom | 84/297 R |
| 1059 | of 1882 | United Kingdom | 84/297 R |

*Primary Examiner*—Lawrence R. Franklin
*Attorney, Agent, or Firm*—Alvin E. Hendricson

[57] ABSTRACT

A bridge pin for guitar or the like is formed of a heavy metal, such as brass to materially increase the presence and the sustain of the instrument.

3 Claims, 7 Drawing Figures

+4
+2
db
0
-1
BRASS
PLASTIC
110
220
440
880
1760
3520
7040
14,080
Hz

0
-5
db
-10
-15
-20
-25
BRASS
PLASTIC
1
2
3
4
5
6
SECONDS

HIGH DENSITY BRIDGE PIN

BACKGROUOND OF INVENTION

The strings of numerous musical instruments are held at the ball end of the strings by pins driven into holes in the bridge of the instrument. These pins were made of wood in the past and are now normally made of plastic. While this manner of securing the string ends is quite satisfactory from an engineering standpoint, it has now been found that a material improvement in the accoustics of stringed instruments can be accomplished with a relatively simple variation in bridge pins.

SUMMARY OF INVENTION

The present invention comprises a bridge pin for stringed instruments, such as guitars for example, wherein the pin is formed of a high density metal, such as brass or the like. While it has generally been thought that a heavy bridge pin would damp the string vibration, it has now been found in accordance with the present invention that quite the contrary is true. The improved bridge pin hereof materially improves the presence, i.e. the volume of frequencies between 2,000 and 10,000 cycles/second. Additionally, and also unexpectedly, the improved bridge pin of the present invention materially improves the sustain, i.e. the time duration of string resonance.

The bridge pin of the present invention is formed of brass or other material having a substantial density as of the order of brass.

DESCRIPTION OF FIGURES

The present invention is illustrated as to the structure of a preferred embodiment and the mounting of such a pin in the accompanying drawing, wherein.

DESCRIPTION OF PREFERRED EMBODIMENT

Figure 1:
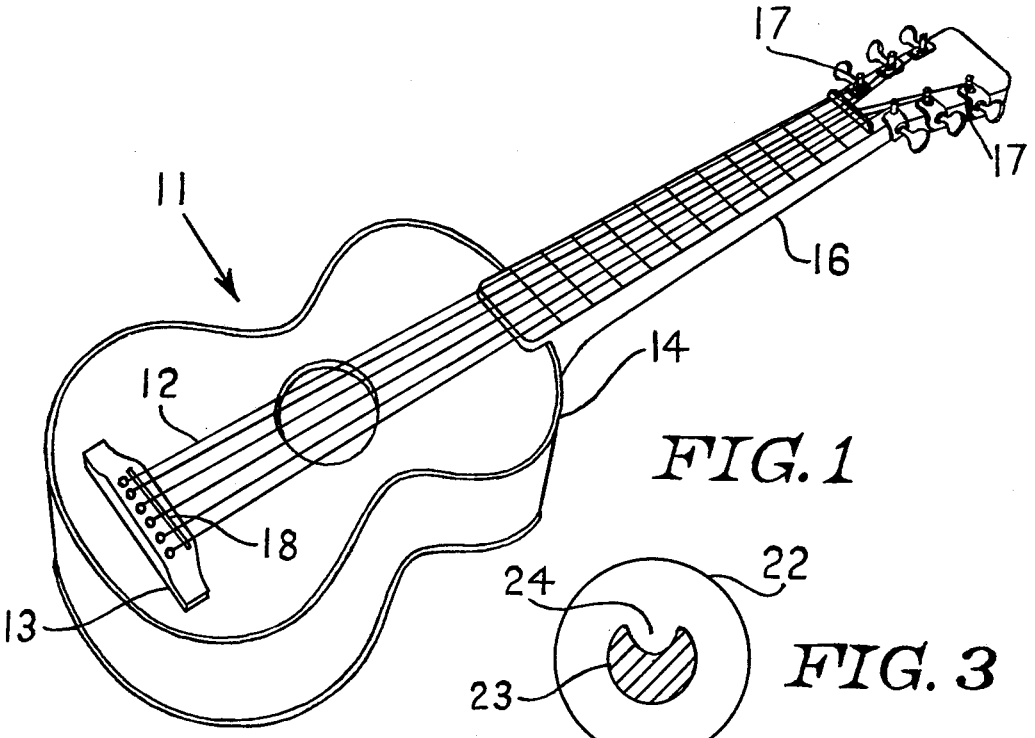
FIG. 1 is a schematic perspective view of a guitar that may include bridge pins in accordance with the present invention.

The improved bridge pin of the present invention is adapted to engage and retain one end of a string of a musical instrument, such as a guitar. In FIG. 1 of the drawings there is generally illustrated a guitar 11 having strings 12 extending from a bridge 13 across the top of the body 14 and along the neck 16 into engagement with separate tuning pins 17. The guitar bridge 13 comprises a raised portion extending laterally across the top of the guitar body 14 adjacent the lower end thereof and is commonly formed of ebony, rose wood, or plastic. This bridge 13 is provided with a saddle 18 or raised ridge across the top thereof across which the strings 12 extend, and a plurality of holes vertically therethrough within which bridge pins 21 are disposed to anchor the lower or ball ends of the strings 12.

Figure 3:
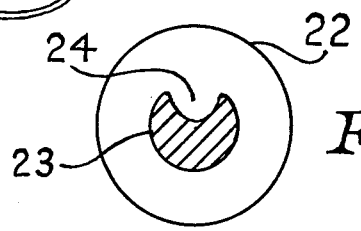
FIG. 3 is a transverse sectional view of the bridge pin of FIG. 2 taken in the plane 3—3 thereof.
Figure 2:
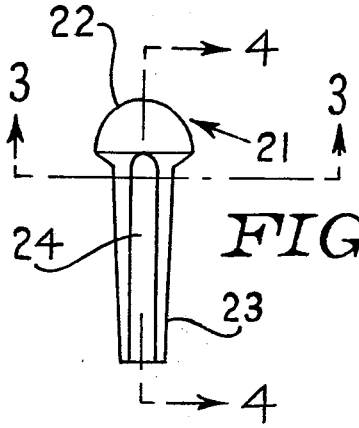
FIG. 2 is a side elevational view of a bridge pin in accordance with the present invention.
Figure 4:
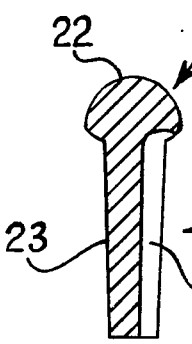
FIG. 4 is a vertical sectional view taken in the plane 4—4 of FIG. 2.

In FIGS. 2, 3, and 4, there is illustrated a bridge pin in accordance with the present invention, and which may have a physical configuration similar to conventional bridge pins. As illustrated, the bridge pin 21 includes an enlarged head 22 with a depending tapered shank 23. A vertical slot 24 is disposed along one side of the shank 23 and this slot extends into the underside of the head 22 for receiving a guitar string with the like, as further described below. In accordance with the present invention, the pin 21 is formed of brass or a metal having a similar or greater density, such as nickel chromium, bronze, etc. Heavier metals and alloys thereof, such as gold may be employed, however, the cost is generally too great for practical or widespread applications.

The bridge pin 21 is adapted to physically engage a string of a musical instrument, such as a guitar string, and the present invention provides a material improvement in musical sound obtainable from a stringed instrument by the use of brass or equivalent material for the bridge pin. Although it is generally considered that a bridge pin formed of a dense material would damp the vibrations of a guitar string or the like, it has been found in accordance with the present invention that the presence is materially improved and also that the strings will then sustain much better. The foregoing terms as employed in connection with stringed instruments relate first to the loudness of frequencies between 2,000 and 10,000 cycles/second, and it has been determined that the bridge pins of the present invention increase the presence as much as 3 db. Sustain is a measure of the time or period of resonance of a string and the present invention has been found to materially increase this resonance. These improvements achieved by the present invention are, in fact, quite marked to the ear and materially enhance the effects that are and can be produced from a stringed instrument, such as a guitar.

Figure 5:
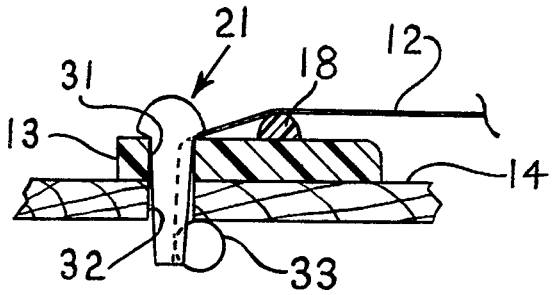
FIG. 5 is a partial sectional view of a guitar bridge showing bridge pin mounting.
Figure 6:
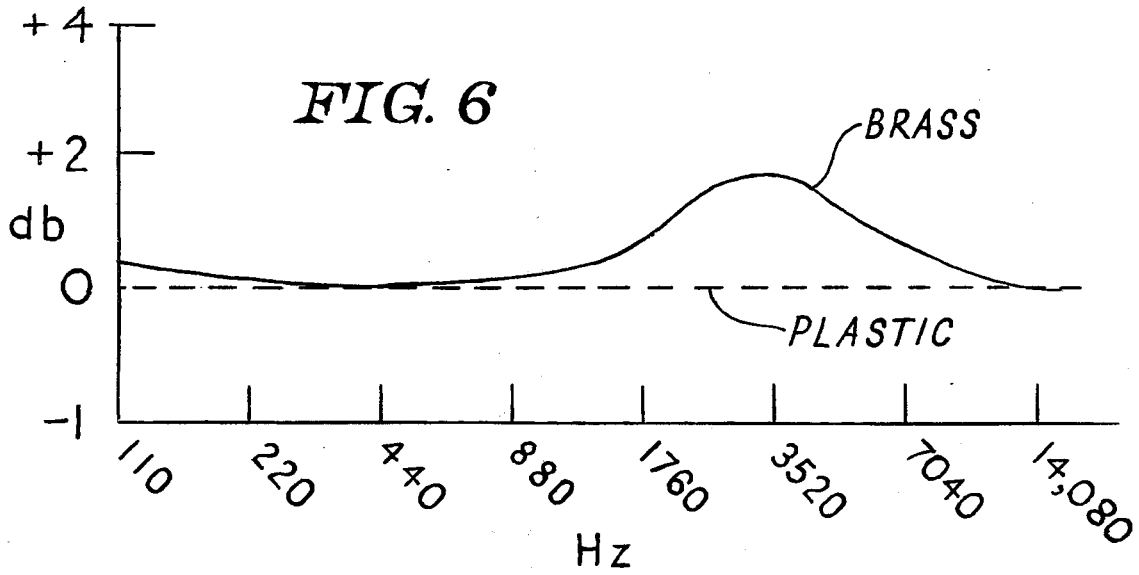
FIG. 6 is a graph illustrating the improvement in presence achieved by the present invention.
Figure 7:
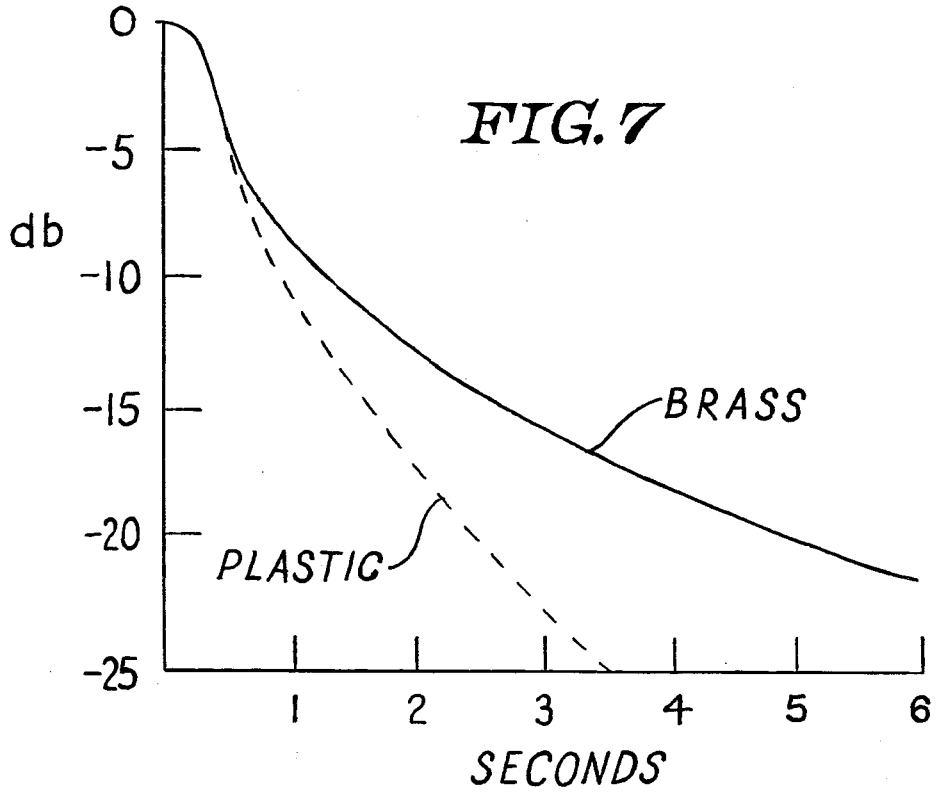
FIG. 7 is a graph illustrating the improvement in sustain achieved by the present invention.

Anchoring of a guitar string 12, for example, by a bridge pin 21 is illustrated in FIG. 5 where it will be seen that the string 12 extends over the saddle 18 atop the bridge 13 and thence downwardly through a hole 31 in the bridge and a mating hole 32 in the top of the guitar body 14. The end of the string 12 is secured to a ball 33 in conventional manner and with the ball end of the string disposed internally of the body 14, a bridge pin 21 is forced downwardly through the holes or openings 31 and 32. The bridge pin 21 is oriented to align the vertical slot 24 therein with the string 12, so that the string lies in this slot with the bridge pin driven into the openings in the bridge and box. It will, of course, be appreciated that the other end of the string 12 is secured to tuning means, and thus forcing the bridge pin through the opening in the bridge will lock the ball end of the string at this location. The ball 33 may be conventionally formed and secured to the end of the string 12. Stringed instrument construction normally calls for bridge pins to be formed of wood or more recently of a plastic having a density somewhat the same as wood. The present invention, quite to the contrary to prior art teachings, comprise brass or some other metal of similar density for the bridge pins of stringed instruments and surprisingly, this does not damp vibrations of the string, but instead enhances these vibrations to improve the presence and sustain time of the instrument. Reference is made to FIG. 6 illustrating the presence of a guitar string secured with a plastic pin by a dashed line and with a brass pin in accordance with the present invention by a solid line. It will be seen that a remarkable improvement is achieved between about 1,000 and 10,000 cycles ($H_2$). Reference is also made to FIG. 7 showing a comparison of sustain of a guitar string mounted with a plastic pin by dashed line and with a brass pin by a solid line. Sustain in improved by 100% at −20 db[1]. The foregoing improvement is quite evident to the human ear and materially enhances the sound obtainable with stringed instruments.

The present invention has been described above with regard to the physical structure, composition and use of the present invention. It will be appreciated to those skilled in the art that certain modifications and variations of the physical configuration and physical composition of the bridge pin or the present invention are possible within the spirit and scope of the present invention.

What is claimed is:

1. An improved bridge pin for stringed instruments comprising a tapered shank depending from an enlarged head and formed of a material having a density of the order of brass.

2. The bridge pin of claim 1 further defined by said pin being formed of brass.

3. The bridge pin of claim 1 further defined by said pin being formed of bronze.

* * * * *